US006639995B2

(12) United States Patent
Yu

(10) Patent No.: US 6,639,995 B2
(45) Date of Patent: Oct. 28, 2003

(54) CONCENTRIC MAGNETIC CONFIGURATION FOR LOUDSPEAKERS

(75) Inventor: You Lian Yu, Beijing (CN)

(73) Assignee: Advanced Magnetic Technologies, Inc., Rancho Dominguez, CA (US)

( * ) Notice: Subject to any disclaimer, the term of this patent is extended or adjusted under 35 U.S.C. 154(b) by 0 days.

(21) Appl. No.: 10/056,731

(22) Filed: Jan. 23, 2002

(65) Prior Publication Data

US 2003/0138125 A1 Jul. 24, 2003

(51) Int. Cl.[7] ..... H04R 25/00

(52) U.S. Cl. ..... 381/412; 381/414; 381/420

(58) Field of Search ..... 381/412, 413, 381/414, 419, 420, 421, 182, 186; 335/222, 223, 281; 181/144, 147

(56) References Cited

U.S. PATENT DOCUMENTS 5,339,286 A * 8/1994 Esposto ..... 381/182
5,987,148 A * 11/1999 Hsieh ..... 381/412

* cited by examiner

*Primary Examiner*—Huyen Le
(74) *Attorney, Agent, or Firm*—Squire, Sanders & Dempsey L.L.P.

(57) ABSTRACT

Disclosed is a concentric magnetic configuration for a speaker system which can produce a full range of frequency sounds from a single source magnet. The magnetic configuration of the present invention includes a high frequency pole plate and one or more middle yoke iron plate placed directly on a cylindrical permanent magnet wherein at least one magnetic flux controlling slot is formed beneath the high frequency pole plate and the middle yoke plate. The multiple air gaps defined by the pole plate and middle yoke iron produce a full range of frequency magnetic fields which can drive the high, medium, and low frequency voice coils.

15 Claims, 4 Drawing Sheets

CONCENTRIC MAGNETIC CONFIGURATION FOR LOUDSPEAKERS

BACKGROUND OF THE INVENTION

1. Field of the Invention

This invention relates to a concentric magnetic configuration for loudspeakers which is designed to produce multiple air gap magnetic fields and which is capable of driving the full-range of high, medium, and low frequency voice coils from a single source magnet.

2. Background

In general, a speaker produces sound by converting an electrical signal into sound waves and radiating the sound waves into free space. When an electric current is caused to flow through a voice coil disposed in a strong magnetic field, a force is generated to cause a vibrating plate to radiate the sound wave.

With conventional loudspeaker magnetic circuit designs known in the art, only one air gap magnetic field is produced from one magnet. As is well known, it is physically difficult to produce a full range of high quality sound frequency from a single voice coil. Therefore, it is necessary to provide separate multiple magnets to reproduce the high, medium and low frequency sounds. Essentially, it is necessary to provide two or three separate speaker systems for each frequency sound, and then physically place these separate speaker systems in one acoustic loudspeaker box (generally referred as a "separate speaker system" hereinafter). Thus, a loudspeaker known in the art is designed to include a tweeter for the high frequency sound, a squawker for the middle frequency sound, and a woofer for the low frequency sound.

However, the size of a speaker cabinet to accommodate all of these separate speaker systems must, by necessity, be quite large and heavy, thus increasing the cost of the loudspeaker. Further, the quality of sound produced form the separate speaker system is often compromised, and not ideal since the high, medium, and low frequency sounds originate from different physical locations or separately located multiple magnets. Still further, synchronization of these different frequency sounds is necessary, further increasing the cost and complicating the. manufacturing process.

Attempts have been thus made to design a loudspeaker capable of producing different frequency sounds without having to utilize a separate speaker system as disclosed in, for example, U.S. Pat. No. 4,164,631, European Patent No. 0 341 926 A1 as well as China Patent Nos. ZL93242815.0, ZL92232080.2, ZL96213090.7, and ZL90216262.4. The systems disclosed in these patents still, however, have problems of being large in size, complex in their configurations, and high in cost. Further, prior to the present invention disclosed and claimed herein, there was no practically useful magnetic configuration which could produce the full range of high, medium and low frequency sounds from a single source magnet.

INVENTION SUMMARY

The present invention relates to a novel design of a single source magnetic configuration for loudspeakers which can produce a full range of sound frequency. In one embodiment, the magnetic configuration is concentric in shape and is adapted to be installed inside of loudspeakers. A cylindrical permanent magnet is provided as a source magnet and multiple air gap magnetic fields are produced to drive the full-range high, medium, and low frequency voice coils from the single magnet. The multiple air gap magnetic fields are produced by placing a high frequency pole plate and one or more middle yoke iron plates directly on the cylindrical permanent magnet. With flux controlling slots in various sizes configured beneath the high frequency pole plate and middle yoke iron plates, the high, medium, and low frequency air gap magnetic fields are achieved with the magnetic configuration of a single magnet.

The unique design of the magnetic configuration is significantly advantageous over traditional ways of creating magnetic fields based on the one magnet/one air gap formula. The magnetic configuration of the present invention design may be used for various speaker systems to provide ideal sound quality in a convenient and inexpensive manner.

Other systems, methods, features and advantages of the invention will be or will become apparent to one of skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

This description is not to be taken in a limiting sense, but is made for the purpose of illustrating the general principles of the invention. The section titles and overall organization of the present detailed description are for the purpose of convenience only and are not intended to limit the present invention.

Figure 1A:
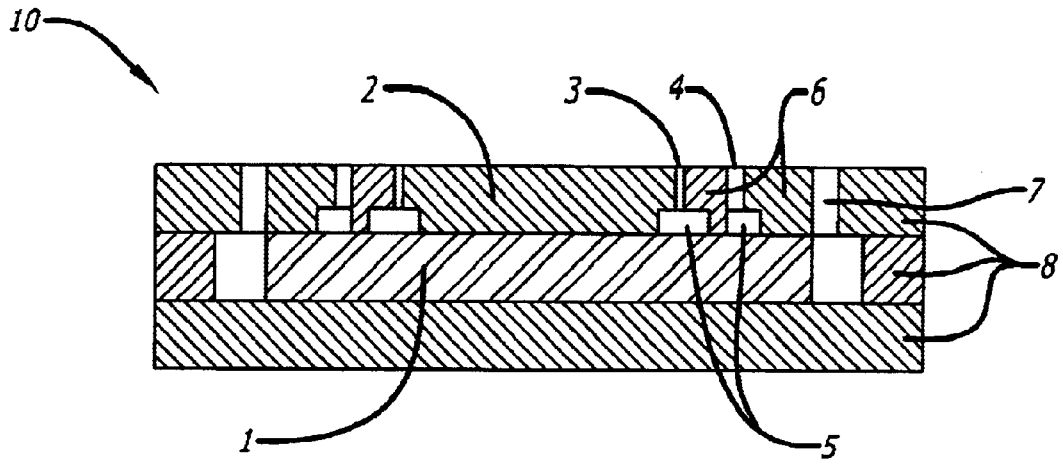
FIG. 1*a* is a cross sectional view of the magnetic configuration according to one embodiment of the present invention.
Figure 1:
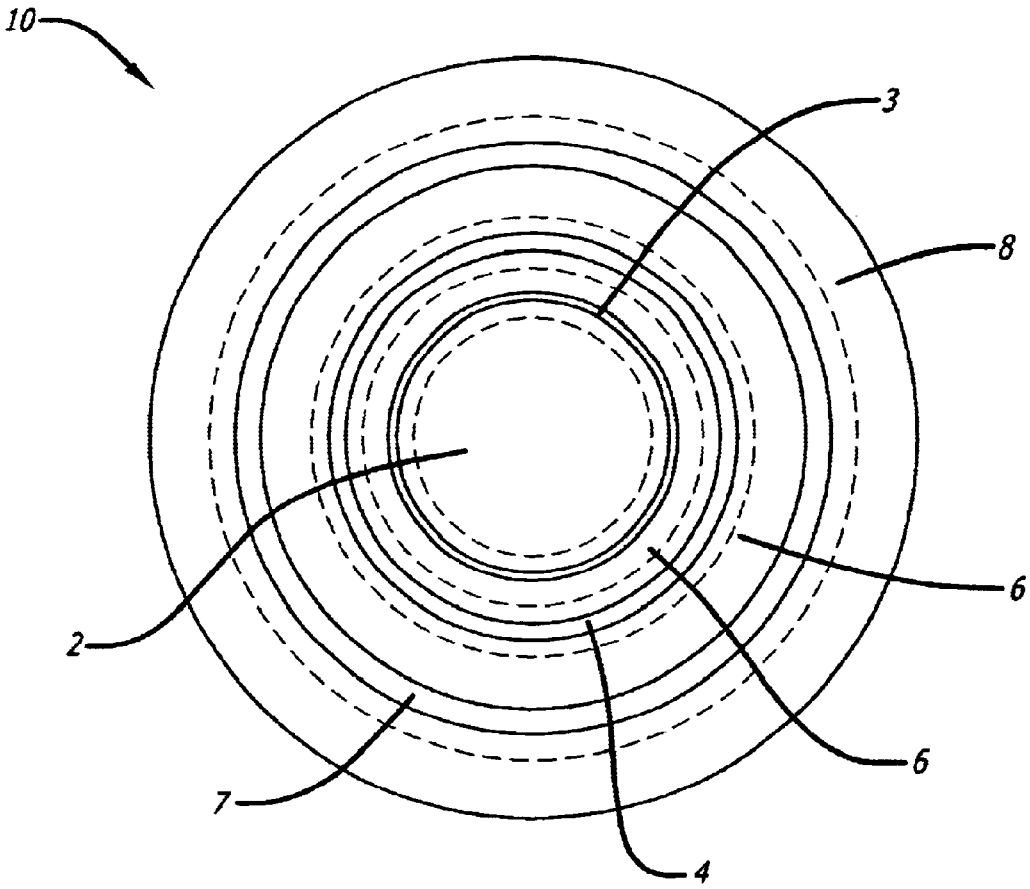
FIG. 1 is a top perspective view of a magnetic configuration according to one embodiment of the present invention.

As illustrated in FIGS. 1 and 1*a*, the magnetic configuration 10 of the present invention comprises a permanent magnet 1, a high frequency pole plate 2, one or more middle yoke iron plates 6, and an outer yoke iron 8. The permanent magnet 1 is preferably cylindrical in shape, and can be Nd—Fe—B or Sm—Co magnets or other permanent magnets known in the art. The middle yoke iron plates 6 and the outer yoke iron 8 may be made of pure iron, low carbon steel or other similarly suitable materials known in the art. The high frequency pole plate 2 and one or more middle yoke iron plates 6 are placed directly on top of the permanent magnet 1, thus forming a high frequency air gap 3, a medium frequency air gap 4, and a low frequency air gap 7.

Underneath the high frequency pole plate 2 and the middle yoke iron plates 6, there are formed flux controlling empty slots 5 that may be configured of different sizes. The magnetic flux generated from the permanent magnet 1 flows through the high frequency pole plate 2, the middle yoke iron plates 6, and the outer yoke iron 8 all about the same time, thereby producing usable air gap magnetic fields between the high frequency air gap 3, the medium frequency air gap 4, and the low frequency air gap 7.

The magnetic configuration 10 of the present invention, as best illustrated in FIG. 1, generally has a concentric configuration having a plurality of air gaps defined by the relative positioning of the high frequency pole plate 2, the middle yoke iron plates 6, and the outer yoke iron 8.

Figure 2:
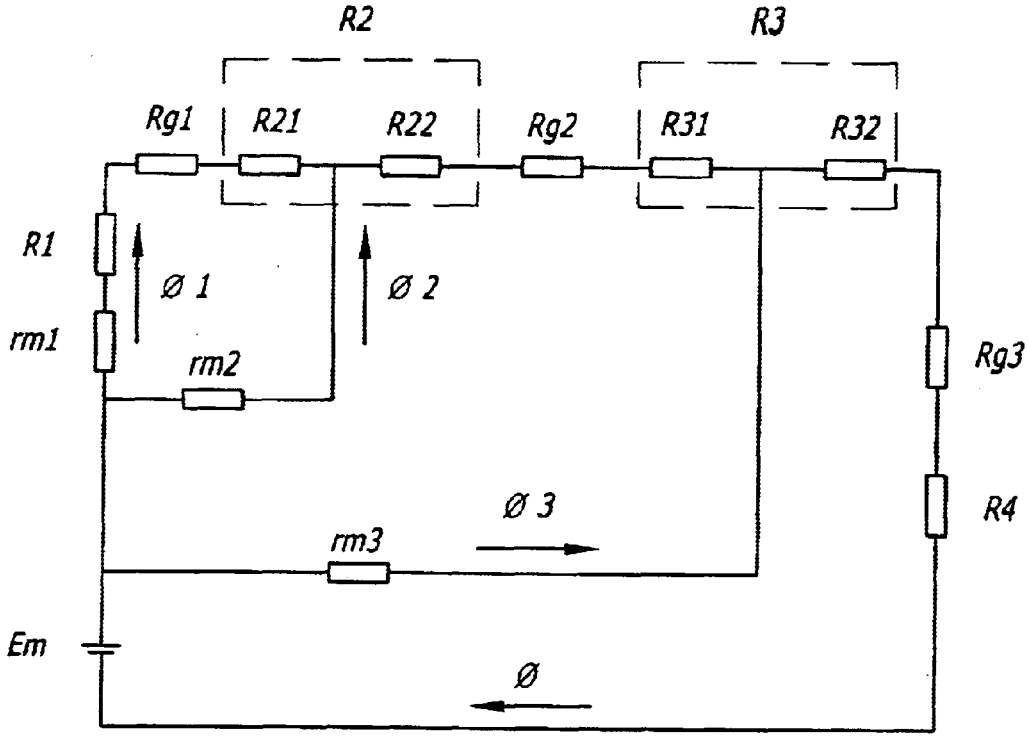
FIG. 2 is an analog electric circuit for the magnetic configuration according to one embodiment of the present invention.

FIG. 2 illustrates the basic working principle of various parts of the magnetic configuration of the present invention referring to concepts such as magnetic reluctance R, magnetic flux $\phi$, and the magnetic potential of the permanent magnet according to the provided analogical electric circuit. FIG. 2 should be viewed together with FIG. 1*a*. FIG. 2 only depicts the right side of FIG. 1*a*, where R1 represents the magnetic reluctance of the high frequency pole plate 2, R2 and R3 refer to the magnetic reluctance for the middle yoke iron plates 6, and R4 represents the magnetic reluctance for the outer yoke iron 8.

Rg1, Rg2, and Rg3 represent the magnetic reluctance for the high frequency air gap 3, the medium frequency air gap 4, and the low frequency air gap 7, respectively. Further, rm1, rm2, and rm3 represent the respective inner magnetic reluctance of the permanent magnet 1 that generates magnetic flux $\phi$1, $\phi$2, and $\phi$3, respectively. $\phi$1 is the magnetic flux that passes through the permanent magnet 1, the high frequency pole plate 2, the high frequency air gap 3, the middle yoke iron plates 6, the medium frequency air gap 4, the low frequency air gap 7, and finally the outer yoke iron 8 as illustrated in FIG. 1*a*. $\phi$2 represents the magnetic flux that passes through the permanent magnet 1, the middle yoke iron plates 6, the medium frequency air gap 4, the low frequency air gap 7, and then the outer yoke iron 8 as shown in FIG. 1*a*. $\phi$3 represents the magnetic flux that passes through the permanent magnet 1, the middle yoke iron plate 6, the low frequency air gap 7, and then the outer yoke iron 8 as shown in FIG. 1*a*.

Thus, based on Ohm's Law for magnetic circuit, $\phi=E/R$, the Magnetic Flux Continuum Law, $\Sigma\phi=0$, as well as Ampere's Law, $\Sigma E=0$, the magnetic flux density in the high frequency air gap 3, the medium frequency air gap 4, and the low frequency air gap 7 can be defined. The magnetic flux distribution from the permanent magnet 1 in the high frequency air gap 3, the medium frequency air gap 4, and the low frequency air gap 7 can be varied by changing or adjusting the size of the magnetic flux controlling slot 5. In other words, the distribution of $\phi$ into $\phi$1, $\phi$2, and $\phi$3 is controlled by the magnetic reluctance R2 (=R21+R22) and R3 (=R31+R32), and it is thus possible to adjust and achieve an optimal distribution of the magnetic field density in the high, medium and low frequency air gaps.

If the magnetic flux controlling slot 5 underneath the high frequency pole plate 2 and the middle yoke iron plates 6 in FIG. 1*a* is absent, the magnetic flux from the permanent magnet 1 will more easily pass through middle yoke iron plates 6 before it passes through the low frequency air gap 7. The magnetic flux density in the high frequency air gap 3 will then become too low. As illustrated in FIG. 1*a*, the magnetic flux controlling slot 5 can enhance the resistance for the magnetic flux passing through the middle yoke iron plates 6, thus forcing magnetic flux to pass through the high frequency pole plate 2.

By adjusting the size of the magnetic flux controlling slot 5 underneath both the high frequency pole plate 2 and the middle yoke iron plates 6, magnetic flux from the permanent magnet 1 will be distributed as desired into the air gaps 3, 4, and 7. With such a simple magnetic circuit configuration, the high, medium, and low frequency air gap magnetic fields can be produced from a single magnet source. The magnetic flux controlling slot 5 can be any shape such as polygonal or circular. By incorporating the magnetic configuration of the present invention with other components that are usually required in a speaker system such as the high, medium, and low voice coils, and an oscillation plate and the like, it is possible to construct a loudspeaker that is capable of providing the full range of high, medium, and low frequency sounds from a single magnet source.

Figure 5:
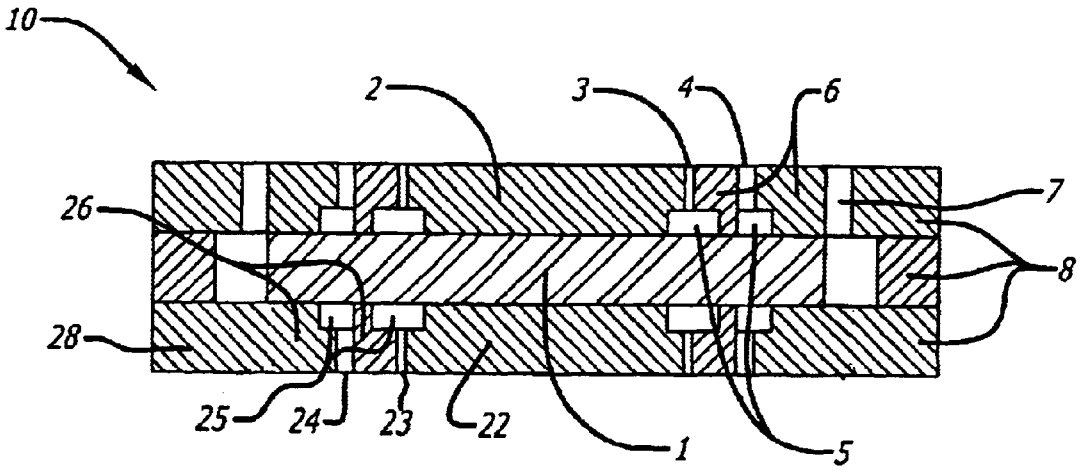
FIG. 5 is a cross-sectional view of the magnetic configuration according to one of the embodiments of the present invention.

Using the principle and design described above, in one embodiment, additional air gap magnetic fields can be formed at the inverse position of permanent magnet 1. For example, as shown in FIG. 5, an additional high frequency air gap 23 can be machined at the bottom side of the permanent magnet 1. There may also be a middle frequency air gap 24 machined at the bottom side of the permanent magnet 1. Further, a low frequency air gap 27 may be machined at the bottom side of the permanent magnet 1. A high frequency pole plate 22, one or more [C]cylindrical yoke iron[s] plates 26 [, preferably with the equal diameter to the magnet 1,] and optionally an outer yoke iron 28 can be placed directly beneath the permanent magnet 1. Above the additional high frequency pole plate 22 and in the middle of the additional yoke iron plates 26, there may be at least one magnetic flux controlling empty slot 25. The additional outer yoke plate 26 should have an inner diameter matched to the diameter of magnet 1 to match the necessary stroke distance of the low frequency voice coil (that is, the up-and-down mobile distance of the low frequency voice coil). Generally, the vibrating stroke magnitude of the high frequency voice coil is very small, which is almost insensitive to naked eyes or finger, while the vibrating stroke magnitude of the low frequency voice coil is relatively large, usually reaching to 10 mm or more.

Further, in another embodiment of the present invention, air and heat circulation holes may be provided in the high frequency pole plate 2 and the permanent magnet 1 for efficient air and heat circulation. Screws may also be provided on the outer yoke iron 8 for easy installation within a loudspeaker cabinet.

Figure 3:
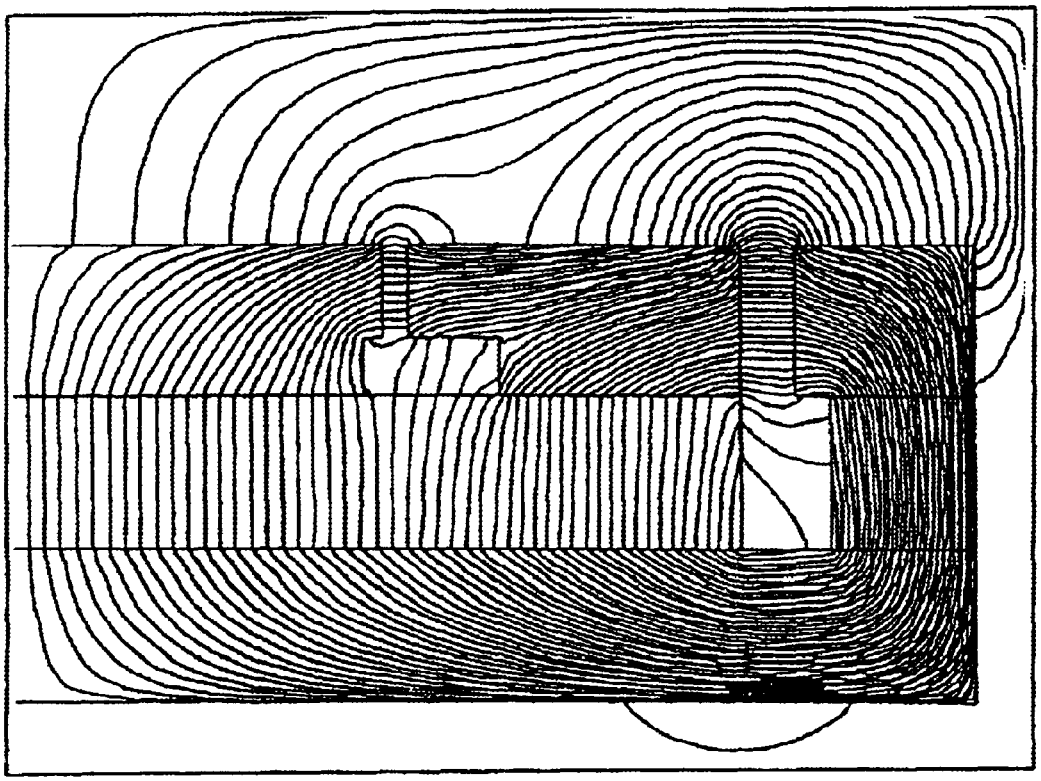
FIG. 3 is a cross section view of the magnetic configuration visually illustrating the magnetic flux distribution according to one embodiment of the present invention.

For the purposes of illustration, FIG. 3 shows the magnetic flux distribution in a dual concentric magnetic field configuration with a single internal magnet design based on the principles described above. A dual concentric magnetic field configuration refers to a magnetic configuration 10 having a high frequency pole plate 2, only one middle yoke iron plate 6 and an outer yoke iron 8 thereby forming only two air gaps. FIG. 3 shows only half of the magnetic flux distribution from the right side of the dual concentric magnetic field configuration.

Figure 4A:
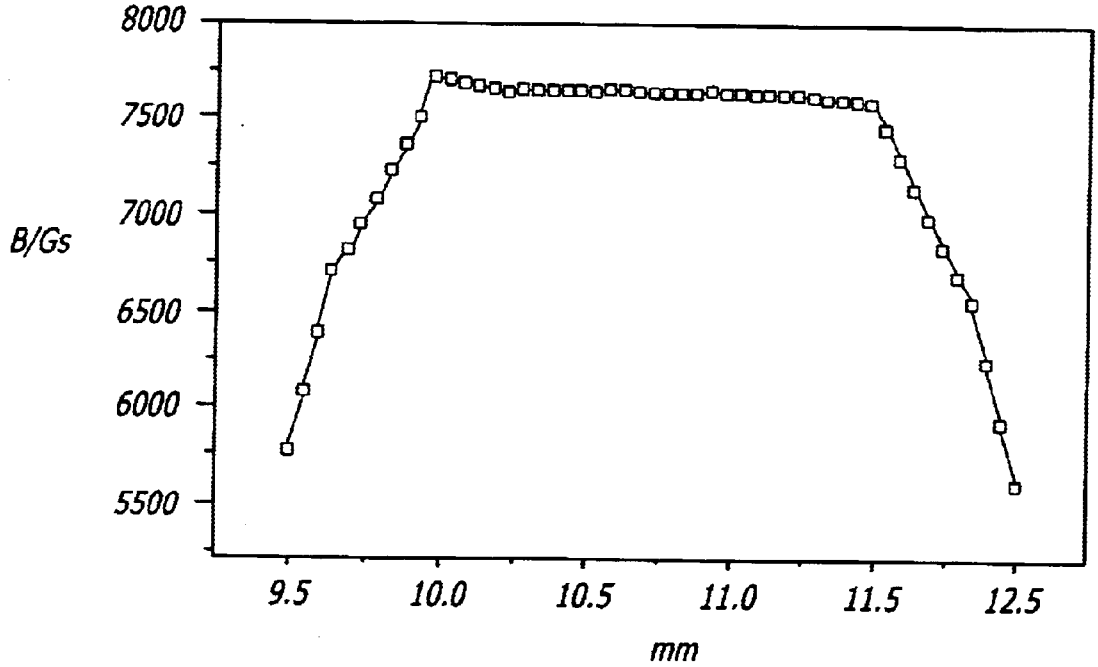
FIG. 4*a* is a graph illustrating the magnetic field strength measurement from a high frequency air gap according to one embodiment of the present invention.
Figure 4B:
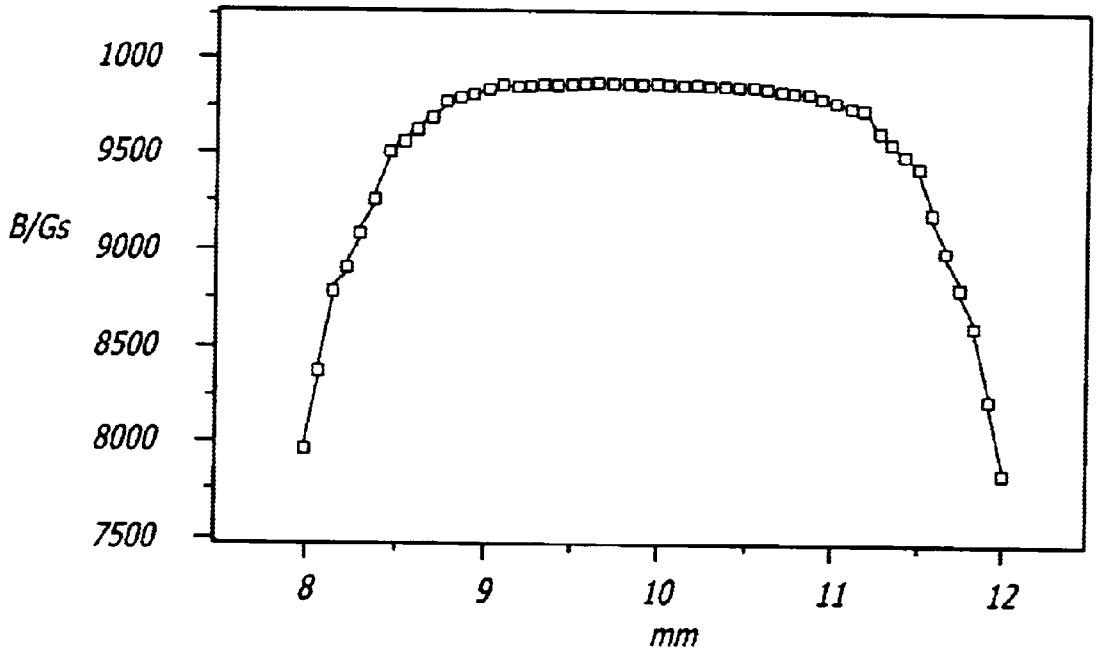
FIG. 4*b* is a graph illustrating the magnetic field strength measurement from a low frequency air gap according to one embodiment of the present invention.

FIGS. 4*a* and 4*b* show the magnetic flux distribution measured from a center portion of high and low frequency air gaps, respectively. In FIGS. 4*a* and 4*b*, the horizontal coordinate axis indicates the position of measurement from the center of the magnetic configuration, and the vertical coordinate axis indicates the magnetic field strength in the center portion of the air gap. In this sample design, a magnetic energy product of 35MGOe sintered Nd—Fe—B magnet with a dimension of $\phi$40×4 mm is used. It can produce about 7.6 kGs applicable magnetic field in the 0.7 mm wide high frequency air gap (the height of the gap is about 2.5 mm) and 9.7 kGs applicable magnetic field in the 1.5 mm wide low frequency air gap (the height of the gap is about 4.0 mm). Both the high and low frequency air gap magnetic field values can satisfy the need for a normal full-range frequency loudspeaker. To further illustrate the function of the magnetic flux controlling slot 5, another embodiment of the magnetic configuration was constructed as shown in FIGS. 1 and 1*a* having identical material parts and dimensions, but not including the magnetic flux controlling slot 5. This particular embodiment without any magnetic flux controlling slot 5 is measured to have a high frequency air gap magnetic field of only about 4.6 kGs and a low frequency air gap magnetic field of 9.9 kGs.

As described above, the magnetic configuration of the present invention is small, thin and simple in design. In one embodiment, the magnetic configuration has a thickness of only about 12 mm and an outer-diameter of about 53 mm. While designed to be magnetic flux leakage proof, the magnetic configuration is capable of producing sounds of the full range of frequency from a single source magnet. Further, the sound quality produced from acoustics systems utilizing the magnetic configuration of the present invention is improved, if not ideal, since all frequency sounds originate from one source magnet. The magnetic configuration of the present invention also eliminates the need to synchronize different frequency sounds coming from separate multiple magnets, and provides a solution to the problems often associated with conventional loudspeaker systems such as high manufacturing cost and large size/heavy weight requirements.

While its use has been generally described in the field of loudspeakers, the magnetic configuration of the present invention may be easily utilized in any acoustics system where it is desirable to have a small/thin size, low weight acoustics system without losing or compromising the high quality full frequency range sound, such as, without limitation, the sound systems for automobiles, wall-hanging sound systems, and super thin televisions.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A magnetic configuration for a speaker system, comprising:

a magnet;

a high frequency pole plate, said high frequency pole plate placed on a top, center portion of said magnet;

at least one middle yoke plate, said middle yoke plate placed on a top, periphery portion of said magnet; and an outer yoke iron defining the outer shape of said magnetic configuration, wherein said high frequency pole plate, said yoke plate, and said outer yoke iron form a plurality of air gaps, and wherein at least one magnetic flux controlling slot is formed beneath said high frequency pole plate and said middle yoke plate.

2. The magnetic configuration of claim 1, wherein a magnetic flux generated from said magnet produces a full range of high, middle, and low frequency magnetic fields through said plurality of air gaps.

3. The magnetic configuration of claim 1, wherein said magnetic configuration comprises two middle yoke plates, and wherein said plurality of air gaps includes a high frequency air gap, a middle frequency air gap, and a low frequency air gap.

4. The magnetic configuration of claim 1, wherein a magnetic flux distribution density generated from said magnet is dependent on the size of said magnetic flux controlling slot.

5. The magnetic configuration of claim 1, wherein said magnetic flux controlling slot is circular or polygonal in shape.

6. The magnetic configuration of claim 1, wherein said magnet is a ND—Fe—B or a Sm—Co based permanent magnet.

7. The magnetic configuration of claim 1, wherein said middle yoke plate and said outer yoke iron are made of pure iron or low carbon steel.

8. The magnetic configuration of claim 1, wherein said magnet, said high frequency pole plate, said middle yoke plate and said outer yoke iron are cylindrical and wherein said magnetic configuration has a concentric formation.

9. The magnetic configuration of claim 1, wherein said speaker system is a loudspeaker, a sound system for automobiles, a wall-hanging sound system, or a super thin television.

10. The magnetic configuration of claim 1, further comprising:

an additional high frequency pole plate placed on a bottom, center portion of said magnet;

at least one additional yoke plate placed on a bottom, periphery portion of said magnet; and an additional outer yoke iron defining the outer shape of said magnetic configuration, wherein said additional high frequency pole plate, said additional yoke plate, and said additional outer yoke iron form an additional plurality of air gaps, and wherein said additional high frequency pole plate, and said additional yoke plate form at least one magnetic flux controlling slot.

11. The magnetic configuration of claim 10, wherein, the additional yoke plate has a diameter that is substantially equal to a diameter of the magnet to match a stroke distance of a low frequency coil.

12. The speaker system according to claim 1, wherein said speaker system is a loudspeaker, a sound system for automobiles, a wall-hanging sound system, or a super thin television.

13. A method of providing a full range frequency sounds from a single magnetic source comprising the steps of:

providing a permanent magnet;

placing a high frequency pole plate and at least one middle yoke plate directly on top of said permanent magnet; and providing an outer yoke iron, wherein said high frequency pole plate, said yoke plate, and said outer yoke iron form a plurality of air gaps, and wherein at least one magnetic flux controlling slot is formed beneath said high frequency pole plate and said middle yoke plate.

14. The method of claim 13, wherein a magnetic flux generated from said magnet produces a full range of magnetic fields through said plurality of air gaps and wherein said full range of magnetic fields is capable of driving separate high, middle, and low frequency voice coils.

15. The method of claim 14, wherein a magnetic flux distribution density generated from said magnet is dependent on the size of said magnetic flux controlling slot.

* * * * *